US007134370B2

(12) United States Patent
Murata et al.

(10) Patent No.: US 7,134,370 B2
(45) Date of Patent: Nov. 14, 2006

(54) SHEET PROCESSING APPARATUS

(75) Inventors: Mitsushige Murata, Chiba (JP); Yuji Morishige, Ibaraki (JP); Itsuo Sekita, Ibaraki (JP); Katsuaki Hirai, Ibaraki (JP); Seiichiro Adachi, Chiba (JP); Naoto Watanabe, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 103 days.

(21) Appl. No.: 10/691,541

(22) Filed: Oct. 24, 2003

(65) Prior Publication Data

US 2004/0161274 A1 Aug. 19, 2004

(30) Foreign Application Priority Data

Oct. 28, 2002 (JP) ..... 2002-312534

(51) Int. Cl.
*B26F 1/24* (2006.01)
*B26D 7/06* (2006.01)

(52) U.S. Cl. ..... 83/13; 83/30; 83/618; 83/446

(58) Field of Classification Search ..... 83/30, 83/357, 368, 618, 628, 571, 572, 692, 690, 83/446, 448, 13

See application file for complete search history.

(56) References Cited

U.S. PATENT DOCUMENTS

| | | | | |
|---|---|---|---|---|
| 2,872,981 | A * | 2/1959 | Fitzpatrick | 83/105 |
| 3,902,954 | A * | 9/1975 | Lotto | 156/510 |
| 4,763,167 | A * | 8/1988 | Watanabe et al. | 347/155 |
| 5,447,297 | A | 9/1995 | Murata et al. | 270/53 |
| 5,509,645 | A * | 4/1996 | Shinno et al. | 270/58.17 |
| 5,961,110 | A | 10/1999 | Adachi et al. | 270/58 |
| 6,065,379 | A * | 5/2000 | Shinno et al. | 83/30 |
| 6,215,977 | B1 * | 4/2001 | Otani | 399/407 |
| 6,672,504 | B1 * | 1/2004 | Ueda et al. | 234/50 |
| 2002/0008350 | A1 | 1/2002 | Adachi et al. | 271/213 |

FOREIGN PATENT DOCUMENTS

| | | |
|---|---|---|
| JP | 11-311883 | 11/1999 |
| JP | 2001-129792 | 5/2001 |

* cited by examiner

*Primary Examiner*—Boyer D. Ashley
*Assistant Examiner*—Omar Flores Sánchez
(74) *Attorney, Agent, or Firm*—Fitapatrick, Cella, Harper & Scinto

(57) ABSTRACT

When performing a punching operation for each of sheets individually conveyed to a predetermined punching position within a conveying path, each of the individually conveyed sheets is positioned at the predetermined punching position before performing the punching operation.

12 Claims, 15 Drawing Sheets

SHEET PROCESSING APPARATUS

BACKGROUND OF THE INVENTION

1. Field of the Invention

The present invention relates to a sheet processing apparatus having a function of performing punching in a sheet.

2. Description of the Related Art

A sheet processing apparatus in which sheets are individually conveyed, and punching is performed in each of the conveyed sheets has been proposed in Japanese Patent Application Laid-Open (Kokai) No. 11-311883 (1999).

In the above-described conventional sheet processing apparatus, however, since conveyed sheets are sequentially punched, position deviation or skew of each sheet with respect to punching means, such as a punch or the like, during a punching operation sometimes causes deviation of a punching position for each sheet. When deviation of a punching position occurs for each sheet, if it is intended to perform binding after performing sheet alignment by superposing a plurality of sheets after punching, the area of punched holes to be used for binding is substantially reduced. As a result, much time is required for a binding operation, or edges are not aligned because a sheet bundle after being bound is oblique with respect to a binder, thereby causing problems in operability and the quality of bound sheets.

SUMMARY OF THE INVENTION

It is an object of the present invention to provide a sheet processing apparatus in which the above-described problems are solved, and a method for controlling such an apparatus.

It is another object of the present invention to provide a sheet processing apparatus that can prevent deviation in the position of a hole by efficiently preventing position deviation and skew of a sheet with respect to punching means during a punching operation, and a method for controlling such an apparatus.

According to one aspect of the present invention, a sheet processing apparatus includes a positioning unit arranged to position each of sequentially conveyed sheets at a predetermined position, a punching unit arranged to perform punching for a sheet positioned by the positioning unit, and a discharge unit arranged to discharge a plurality of sheets punched by the punching unit in a superposed state.

According to another aspect of the present invention, an image forming apparatus includes an image forming unit arranged to form an image on a sheet, a positioning unit arranged to position each of sequentially conveyed sheets on which images have been formed by the image forming unit, at a predetermined position, a punching unit arranged to perform punching for the sheet positioned by the positioning unit, and a discharge unit arranged to discharge a plurality of sheets punched by the punching unit in a superposed state.

According to still another aspect of the present invention, a method for controlling a sheet processing apparatus for performing punching in each of sheets includes the steps of positioning each of sequentially conveyed sheets at a predetermined position, performing punching for a sheet positioned in the positioning step, and discharging a plurality of sheets punched in the punching step in a superposed state.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

A description will now be provided of a sheet processing apparatus and an image forming apparatus including the same, according to a preferred embodiment of the present invention.

Figure 1:
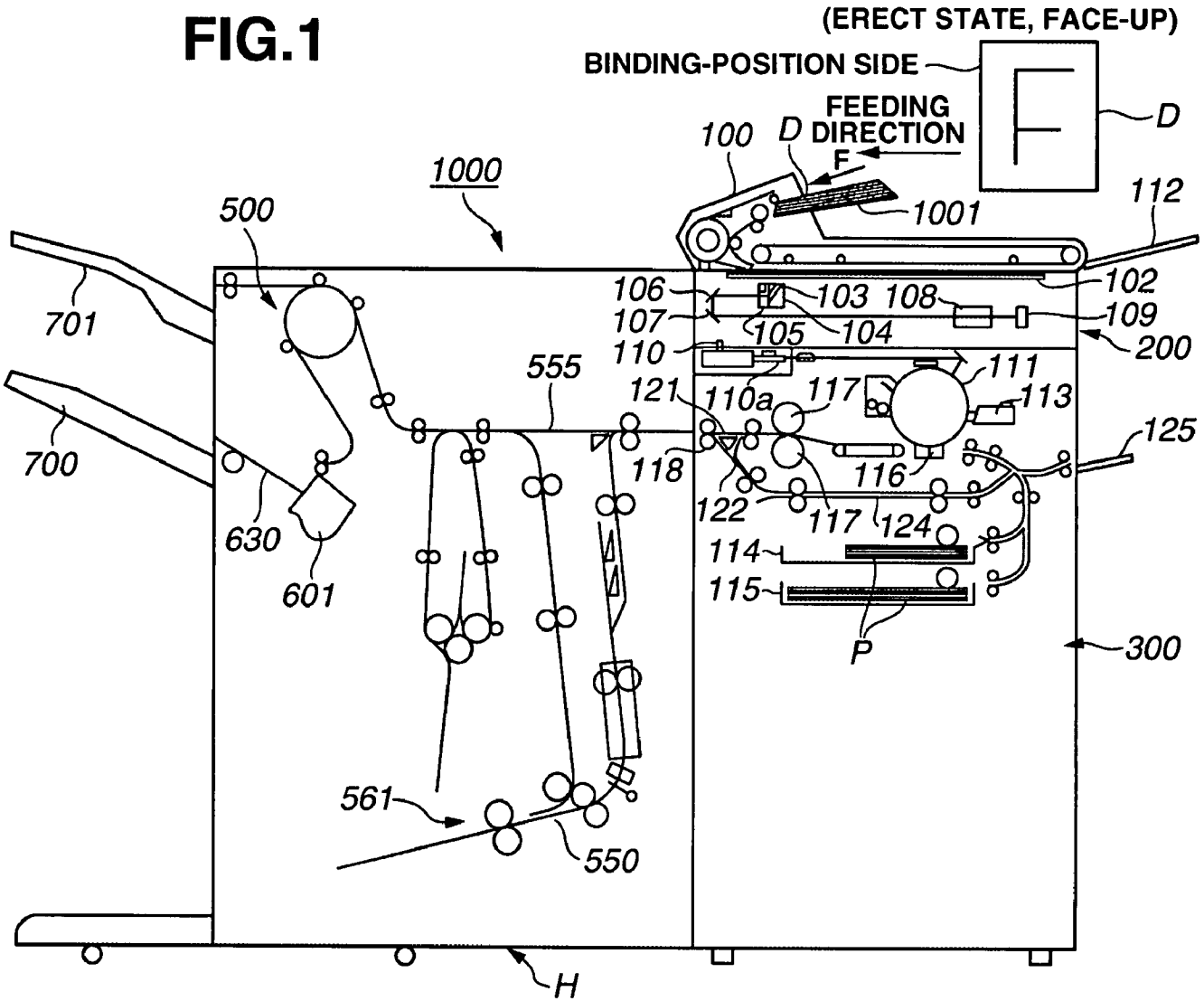
FIG. 1 is a cross-sectional view illustrating the internal structure of a copier, serving as an image forming apparatus including a sheet processing apparatus according to a preferred embodiment of the present invention.

FIG. 1 is a cross-sectional view illustrating the internal structure of a copier 1000, serving as an image forming apparatus including a sheet processing apparatus, according to the preferred embodiment. The copier 1000 includes an original-feeding unit 100, an image-reader unit 200, a printer unit 300, and a sheet processing unit H, serving as a sheet processing apparatus including a finisher unit 500, a punching processing unit 550 and the like (to be described later).

As shown in FIG. 1, an original D is mounted on a feeding tray 1001 of the original-feeding unit 100 in an erect state as seen from the user and in a face-up state (a state in which a surface having an image thereon is placed upward).

Sheets of the original D mounted on the feeding tray 1001 are individually fed to an original-feeding direction (in a direction F) starting from the leading page by the original-feeding unit 100. A binding position or a punching position of the original D is positioned near a downstream end portion in the feeding direction (hereinafter termed a "leading edge") of the original D. That is, the original D is fed by making the leading-edge side the binding position or the punching position.

Then, the image on the original D is read by conveying the original D from the left toward the right in FIG. 1 on platen glass 102 of the image reader unit 200, passing through a curved path (a conveying path) within the original feeding unit 100. The read original D is discharged and mounted onto a discharge tray 112.

The image reader 200 includes a scanner unit 104 that is disposed below the platen glass 102 so as to be movable substantially parallel with the platen glass 102, and that can read the original D mounted on the platen glass 102.

When the original D is conveyed on the platen glass 102 in the above-described manner, the scanner unit 104 remains to stop at a predetermined position. Processing of reading the image on the original D is performed by passage of the original D on the stopped scanner unit 104 (such original-image reading processing will be hereinafter termed "original-flowing reading"). When the original D passes on the platen glass 102, the original D is illuminated by a lamp 103 of the scanner unit 104. Reflected light from the original D is guided to an image sensor 109 via mirrors 105, 106 and 107, and a lens 108.

It is also possible to read the image on the original D by temporarily stopping the original D fed by the original-feeding unit 100 on the platen glass 102, and moving the scanner unit 104 from the left toward the right in FIG. 1 while the original D remains to stop, in order to perform scanning (such original-image reading processing will be hereinafter termed "original-fixing reading").

The original-feeding unit 100 of the copier 1000 is disposed so as to be openable/closable above the platen glass 102 of the image reader unit 200. When reading the image on the original D without using the original-feeding unit 100, the user mounts the original D on the platen glass 102 by opening the original-feeding unit 100. The above-described original-fixing reading is performed for the mounted original D.

Image data of the original D read by the image sensor 109 in the above-described manner is transmitted to an exposure control unit 110 after being subjected to predetermined image processing. The exposure control unit 110 outputs a laser beam corresponding to an image signal. The laser beam is projected onto a photosensitive drum 111 while being scanned by a polygonal mirror 110*a*. An electrostatic latent image corresponding to the scanned laser beam is formed on the photosensitive drum 111.

The electrostatic latent image formed on the photosensitive drum 111 is visualized as a toner image by being developed by a developing unit 113.

The printer unit 300 includes cassettes 114 and 115, a manual insertion unit 125, and a duplex conveying path 124 as means for supplying a sheet P. The sheet P is supplied to a transfer unit 116 from one of these units. Then, the visualized toner image is transferred onto the sheet P at a transfer unit 116. The sheet P after image transfer is subjected to fixing processing at a fixing unit 117.

The sheet P passing through the fixing unit 117 is guided to a path 122 by a flapper 121. After an upstream end portion in the conveying direction (hereinafter termed a "rear edge") of the sheet P has passed through the flapper 121, the sheet P is subjected to switchback conveyance, and is conveyed to discharge rollers 118 by the flapper 121 in a state in which the surface of the sheet P is reversed. Then, the sheet P is discharged from the printer unit 300 by the discharge rollers 118. By performing such processing, the sheet P can be discharged from the printer unit 300 in a face-down state (a state in which the surface of the sheet P having the formed image is placed downward). This processing is termed "reversal discharge".

By discharging the sheet P outside of the apparatus in the face-down state in the above-described manner, when performing image forming processing sequentially from the leading page, i.e., for example, when performing image forming, processing using the original-feeding unit 100, or when performing image forming processing for image data from a computer, the sheet P can be discharged and mounted in a state in which the order of pages is correct.

When performing image forming processing by feeding a hard sheet, such as an OHP (overhead projector) sheet or the like, from the manual insertion unit 125, the sheet is discharged from the printer unit 300 by the discharge rollers 118 in a state in which the surface of the sheet P having a formed toner image is placed upward (a face-up state), without guiding the sheet into the path 122.

When performing image forming processing for both surfaces of the sheet P, the sheet P subjected to fixing processing at the fixing unit 117 is directly guided toward the discharge rollers 118 by the flapper 121. Immediately after the rear edge of the sheet P has passed through the flappers 121, the sheet P is subjected to switchback conveyance, and is guided toward the duplex conveying path 124 by the flapper 121.

Figure 2A:
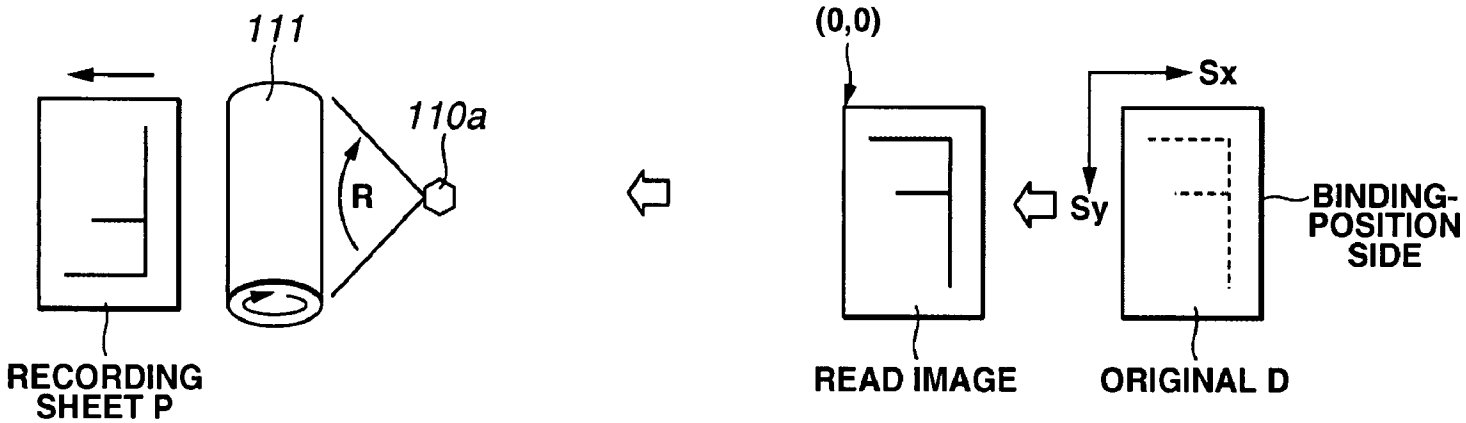
FIGS. 2A and 2B are diagrams illustrating image forming processing when an original is read in a fixed state and when an original is read while flowing, respectively.
Figure 2B:
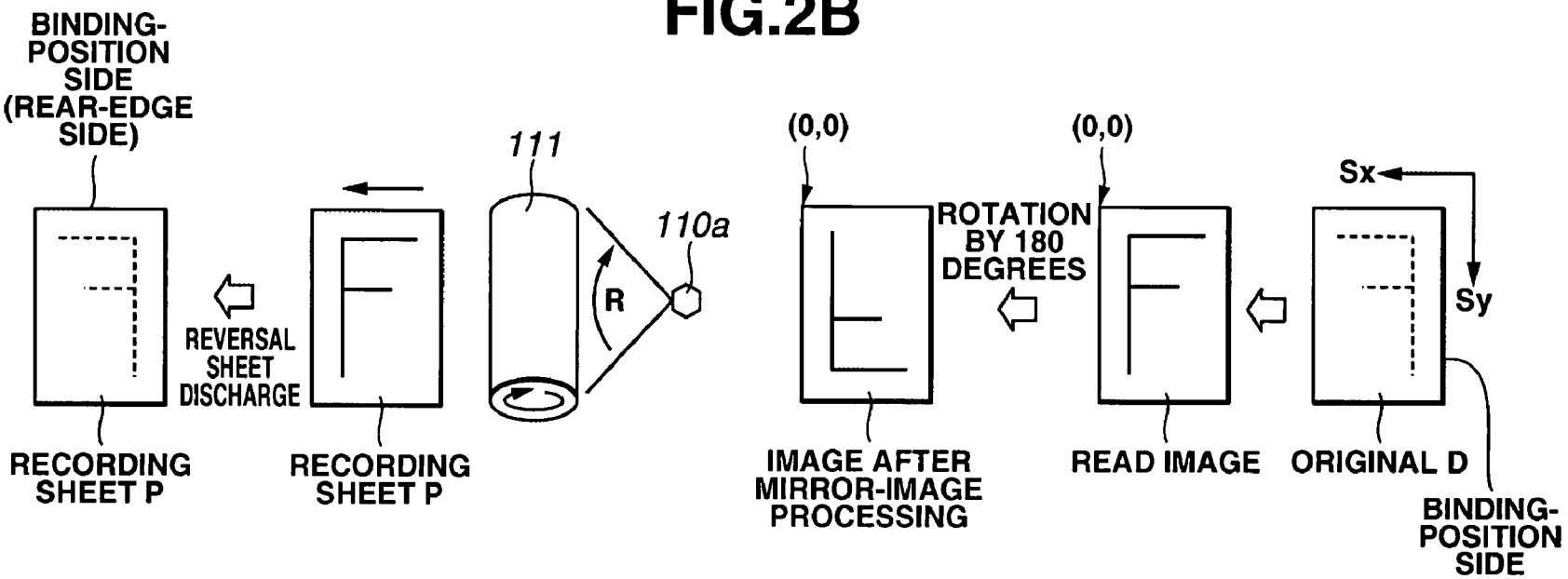

Next, a description will be provided of image forming processing in each of the original-fixing reading and the original-flowing reading with reference to FIGS. 2A and 2B, respectively.

As described above, in the original-fixing reading, the image on the original D is read by causing the scanner unit 104 to perform scanning while moving. That is, as shown in FIG. 2A, reading scanning in which a main scanning direction and a sub-scanning direction are represented by Sy and Sx, respectively, is performed for the image on the original D, in order to read the image of the original D by the image sensor 109. As for image information (the read image shown in FIG. 2A) read by the image sensor 109, image information read in the main scanning direction Sy is sequentially converted into a laser beam by the exposure control unit 110. By causing the laser beam to perform scanning in the direction of an arrow R by the polygonal mirror 110*a*, an electrostatic latent image is formed on the photosensitive drum 111.

By visualizing the formed electrostatic latent image as a toner image on the sheet P, an erect image that is not a mirror image (a non-mirror image) is formed on the sheet P as shown in FIG. 2A.

In the original-flowing reading, as shown in FIG. 2B, reading scanning, in which a main scanning direction and a sub-scanning direction are represented by Sy and Sx', respectively, is performed for the image on the original D, in order to read the image of the original D by the image sensor 109. In the original-flowing reading, since the original D is conveyed from the left toward the right in FIG. 1, the sub-scanning direction Sx' is inverse to the sub-scanning direction Sx in the original-fixing reading. Accordingly, the image read by the image sensor 109 is a mirror image of the image of the original D. Hence, the mirror image must be corrected to an erect image. Accordingly, in the original-flowing reading, mirror-image processing for converting image information read by the image sensor 109 into an erect image is performed. In the mirror-image processing, in order to convert the direction of image data in the main scanning direction Sy into the reverse direction, an image read in one main scanning direction is inverted in the inverse direction.

That is, the mirror-image processing of this embodiment is processing of rotating image information read from the original D by 180 degrees and outputting resultant image information. The processing of rotating an input image by 180 degrees will be hereinafter termed "mirror-image processing".

According to the above-described mirror-image processing, the image read by the image sensor 109 is converted into an erect image (refer to an image after mirror-image processing shown in FIG. 2B). An electrostatic latent image based on the image after mirror-image processing is formed on the photosensitive drum 111. The electrostatic latent image formed on the photosensitive drum 111 is visualized as a toner image. By forming the toner image on a sheet, an erect image that is not a mirror image is formed on the sheet.

By performing reversal discharge of the sheet P having the image formed thereon, as shown in FIG. 2B, the sheet P can be discharged from the printer unit 300 in a state in which the surface of the sheet P having the formed toner image is placed downward (the face-down state). By binding the rear edge of each sheet P thus subjected to reversal discharge using a stapler 601 of the finisher unit 500 (to be described later), the left side of the formed image on each sheet P, as seen from the surface having the image, can be bound.

After passing through the above-described processing, the sheet P having the image formed thereon is discharged from the printer unit 300 by the discharge rollers 118, and is fed to the punching processing unit 550 within the sheet processing unit H (see FIG. 1). In the punching processing unit 550, punching processing of punching two holes, three holes, four holes or the like for file binding can be performed for the sheet P. These holes are punched in a direction of arrangement substantially parallel with the sheet conveying direction or in a direction of arrangement substantially perpendicular to the sheet conveying direction.

In the punching processing unit 550, if punching processing is performed for the sheet P subjected to the above-described reversal discharge in order to perform punching processing at the leading-edge side of the conveyed sheet P, end portions opposite to the binding position are punched. Accordingly, when performing punching processing, reversal discharge within the printer unit 300 is not performed. The sheet P is fed to the punching processing unit 550 in a state in which the surface of the sheet P having the formed toner image is placed upward (the face-up state). After performing punching processing, the surface of the sheet P is reversed by a reversal unit 561 disposed at a portion downstream from the punching processing unit 550 in the conveying direction. Then, the sheet P whose surface has been reversed is discharged from the punching processing unit 550 in a state in which the surface of the sheet P is placed downward, and is guided to a conveying path 402 toward a folding processing unit 400 after passing through a conveying path 578.

The sheet P discharged from the punching processing unit 550 or discharged from the printer unit 300 by the discharge rollers 118 without being subjected to punching processing is conveyed to the folding processing unit 400. In the folding processing unit 400, processing of folding the sheet P in the shape of Z is performed. For example, folding processing is performed for an A3-size or B-4 size sheet for which assignment of folding processing has been performed through an operation unit 1 (to be described later). In other cases, the sheet P is fed to the finisher unit 500 without being subjected to folding processing.

Figure 3:
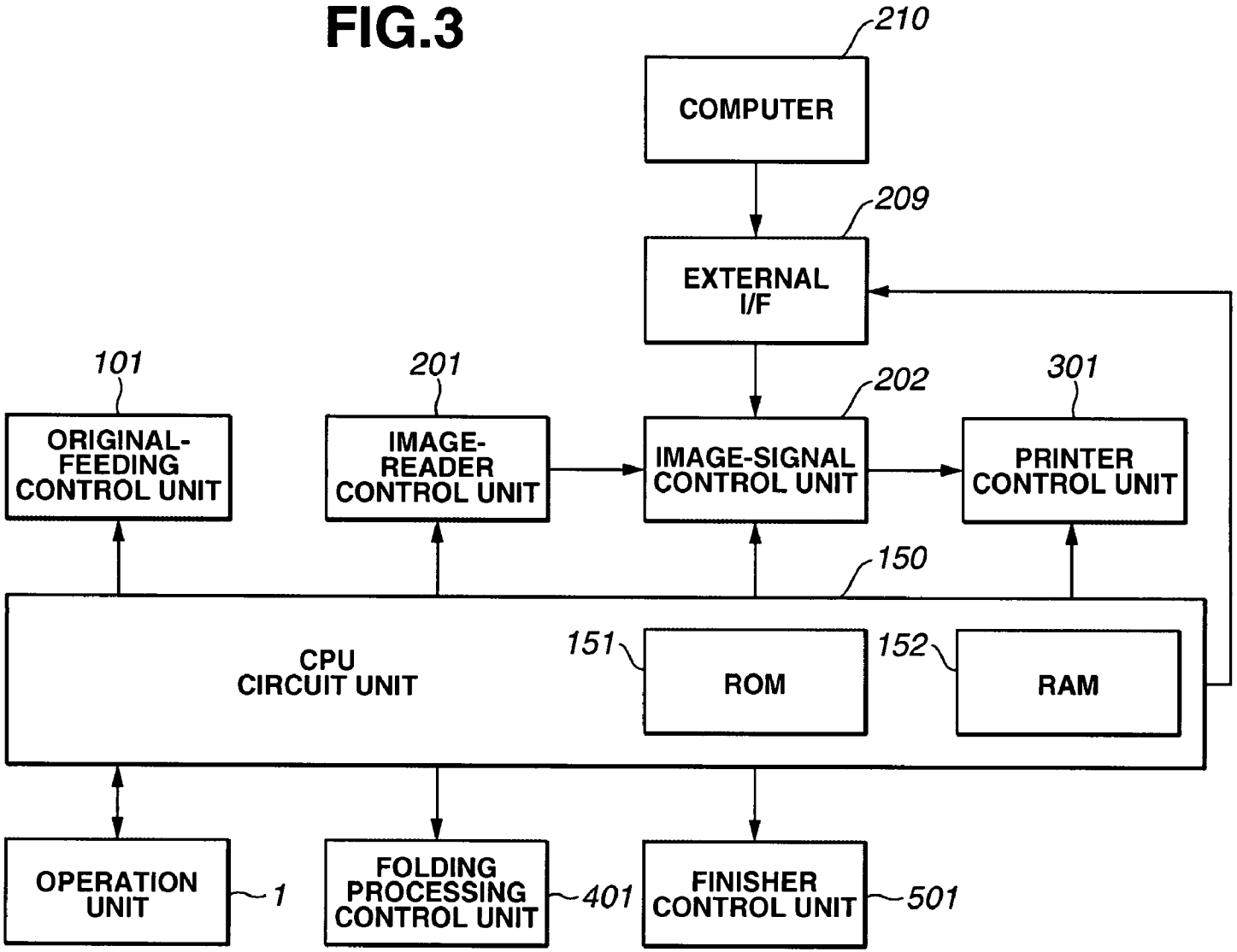
FIG. 3 is a functional block diagram of the copier shown in FIG. 1.

FIG. 3 is a functional block diagram of the copier 1000. In FIG. 3, a CPU (central processing unit) circuit unit 150 includes a CPU (not shown), and controls an original-feeding control unit 101, an image-reader control unit 201, an image-signal control unit 202, a printer control unit 301, a punching control unit (not shown), a folding-processing control unit 401, a finisher control unit 501, and an external I/F (interface) 209, according to control programs stored in a ROM (read-only memory) 151 and settings on the operation unit 1. The original-feeding control unit 101, the image-reader control unit 201, the printer control unit 301, the punching control unit, the folding-processing control unit 401 and the finisher control unit 501 control the original-feeding unit 100, the image-reader unit 200, the printer unit 300, the punching processing unit 550, the folding processing unit 400 and the finisher unit 500, respectively.

The operation unit 1 includes a plurality of keys for setting various functions relating to image formation, a display panel for displaying a setting state, and the like. The operation unit 1 outputs a key signal corresponding to each type of key operation by the user to the CPU circuit unit 150, and displays information corresponding to a signal from the CPU circuit unit 150 on the display panel.

A RAM (random access memory) 152 is used as a region for temporarily holding control data, or an operation region for calculation relating to control. The external I/F 209 is an interface between the copier 1000 and an external computer 210. The external I/F 209 develops print data received from the computer 210 into a bit-map image, and outputs the resultant data to the image-signal control unit 202 as image data. The image-reader control unit 201 transmits image information of the original D read by the image sensor 109 to the image-signal control unit 202. The printer control unit 301 outputs image data from the image-signal control unit 202 to the exposure control unit 110.

Figure 4:
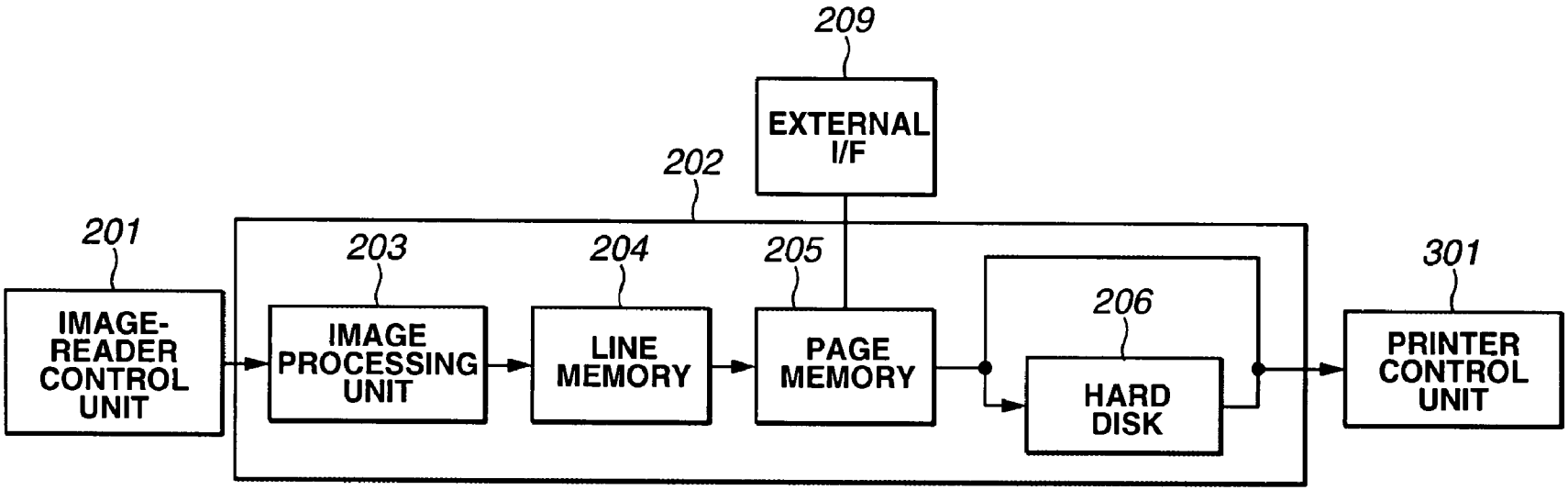
FIG. 4 is a functional block diagram illustrating the details of an image-signal control unit shown in FIG. 3.

FIG. 4 is a functional block diagram of the image-signal control unit 202. The image-signal control unit 202 includes an image processing unit 203, a line memory 204, a page memory 205, and a hard disk 206. The image processing unit 203 performs correction processing of image information and editing processing in accordance with settings from the operation unit 1. In the line memory 204, the above-described mirror-image processing is performed. Image information output from the line memory 204 is input to the printer control unit 301 via the page memory 205. The hard disk is used for processing of changing the order of pages, i.e., electronic sorting, or the like.

Next, a description will be provided of the configurations of the punching processing unit 550, the folding processing unit 400 and the finisher unit 500 with reference to FIGS. 5A–5D. FIGS. 5A–5D are diagrams illustrating the configurations of the punching processing unit 550, the folding processing unit 400 and the finisher unit 500 that have been described with reference to FIG. 1.

The sheet processing unit H includes a conveying path 555 for guiding the sheet P discharged from the printer unit 300 toward the folding processing unit 400 and the finisher unit 500. A pair of conveying rollers 556 are provided along the conveying path 555, and a switching flapper 557 is provided near the conveying rollers 556 at the downstream side. The switching flapper 557 guides the sheet P conveyed by the pair of conveying rollers 556 to one of a punching path 558 toward the punching processing unit and a conveying path 402 toward the folding processing unit 400.

When performing punching processing, by switching the switching flapper 557 toward the punching path 558, the sheet P is guided to the punching path 558. The sheet P guided to the punching path 558 passes through a size-switching flapper unit 568 by a pair of conveying rollers 559, and the leading edge of the sheet P contacts a punching stopper 563 provided at a downstream portion in the conveying direction of a sheet accommodating path 569.

The size-switching flapper unit 568 performs a switching operation so that the order of conveyance of the sheet P to the punching processing unit 550 does not change, and the rear edge of the sheet already conveyed to the punching processing unit 550 does not contact the leading edge of the subsequently conveyed sheet. That is, when conveying a large-size sheet to the punching processing unit 550, a size-switching flapper 568*a* disposed at the most upstream portion in the conveying direction is rotated in the direction of an arrow A, in order to guide the sheet to the sheet accommodating path 569. When conveying a small-size sheet to the punching processing unit 550, if the sheet conveying path is switched to the sheet accommodating path 569 at the position of the size-switching flapper 568*a* as in the case of a large-size sheet, the rear edge of the sheet already conveyed to the punching processing unit 550 sometimes contacts the leading edge of the subsequently conveyed sheet. Accordingly, when conveying a small-size sheet, switching of the conveying path is performed by a size-switching flapper 568*b* disposed at a more downstream side in the conveying direction than the size-switching flapper 568*a*, in order to guide the sheet to the sheet accommodating path 569. When conveying a further-smaller-size sheet, the sheet is conveyed along the guide shape of the punching path 558 without switching the sheet conveying path by the size-switching flapper unit 568, and is conveyed to the punching processing unit 550. The sheets are individually conveyed to the punching processing unit 550.

In this embodiment, sheets of three sizes can be handled using the two size-switching flappers 568*a* and 568*b*. However, by further increasing the number of size-switching flappers, sheets of a larger number of sizes can be handled.

Figure 5A:
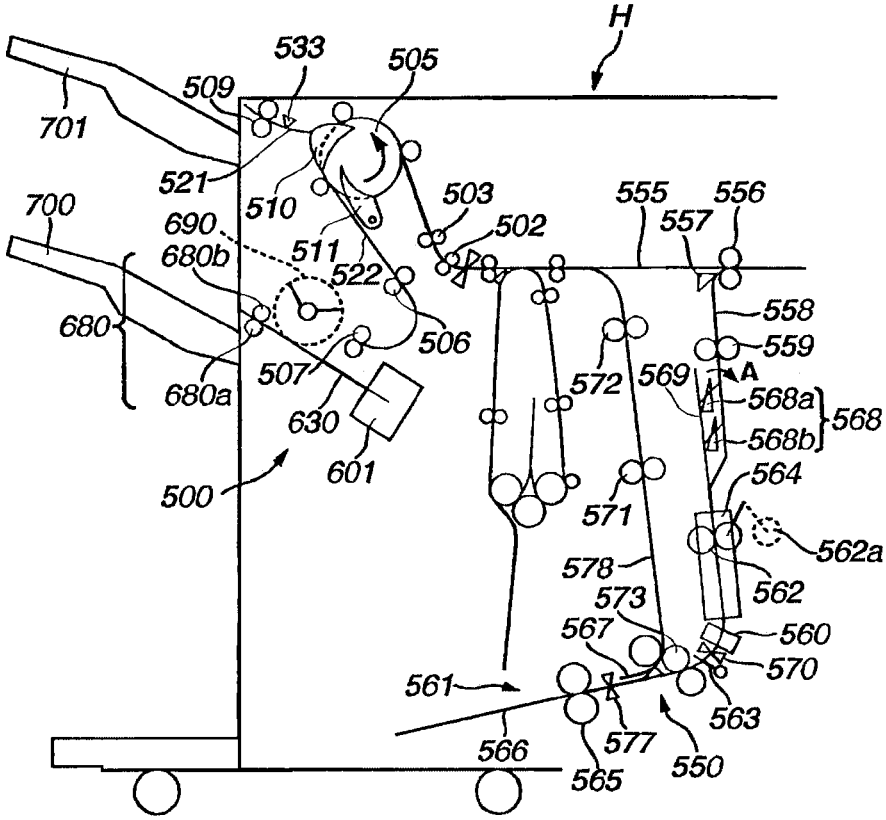
FIGS. 5A–5D are diagrams illustrating a punching processing unit, a folding processing unit and a finisher unit.

When the rear edge of a sheet P passes through the pair of conveying rollers 559, the leading edge of the sheet P contacts the punching stopper 563, and the entire sheet is accommodated within the sheet accommodating path 569, one roller 562*a* of a pair of pressing rollers 562 swings to separate from the sheet P (a position indicated by broken lines in FIG. 5A). The sheet is thereby aligned by an aligning plate (a pair of grasping surfaces) 564, serving as aligning means, in a state in which the sheet P is hardly influenced by a conveyance resistance due to the pair of pressing rollers 562, and the like. Sides substantially parallel with the sheet conveying direction (both end portions E in the lateral direction of the sheet) are aligned by being grasped by the aligning plate 564 (i.e., positioned at a predetermined punching position in a direction substantially orthogonal to the sheet conveying direction) (See FIG. 5D). The leading edge of the sheet P contacts a stopper (contact member) 563, serving as contact means, by the sheet's own weight, so that the sheet P is correctly positioned at a predetermined punching position in the conveying direction.

The aligning plate 564 has a pair of surfaces disposed substantially parallel to the sheet conveying direction, and at least one of these two grasping surfaces is movable in a direction substantially orthogonal to the sheet conveying direction.

The stopper 563 is disposed so as to be movable between a contact position for performing a positioning operation in a state in which the leading edge of the conveyed sheet contacts and a retracting position where sheet conveyance is not hindered.

The apparatus is controlled so that the above-described sheet positioning operation (aligning operation) by the aligning plate 564 and the stopper 563 is performed for each sheet before a sheet punching operation by the punching unit 560.

Upon completion of accommodation of the sheet in the sheet accommodating path 569 in the above-described manner, the next sheet discharged from the printer unit 300 is allowed to enter the punching path 558 of the punching processing unit 550. That is, it is possible to convey the subsequent sheet during processing of aligning/punching the sheet already conveyed into the punching processing unit, and superpose the subsequent sheet in the sheet accommodating path 569 (see FIG. 5A). Since the sheets can be superposed in the above-described manner, a time allowance for performing processing of aligning/punching the sheets, and the like is provided, so that sheet aligning/punching processing and the like can be performed even if an image forming operation, in which sheets are discharged with a short time interval in a state in which the performance of the printer unit 300 is sufficiently utilized, is performed.

Figure 5B:
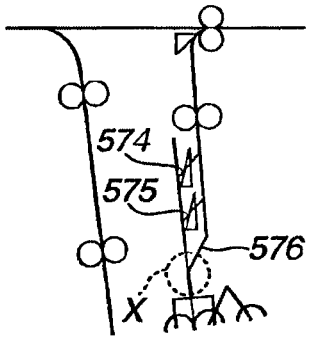
Figure 5C:
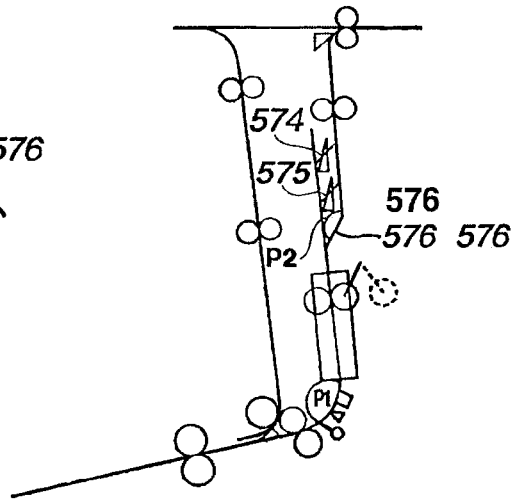
Figure 5D:
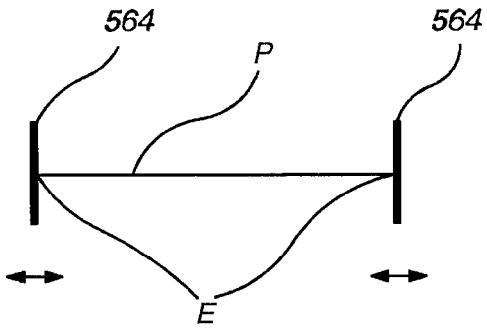

When the number of sheets superposed within the sheet accommodating path 569 is equal to or less than two, a confluent portion of sheets can always be at the position of X shown in FIG. 5B by using the above-described size-switching flappers. That is, in the case of a large-size sheet, an odd-numbered sheet is guided into the sheet accommodating path 569 positioned at the left side in FIG. 5A after passing through a path 574, by rotating the size-switching flapper 568*a* to a position shown in FIG. 5A (in the direction of A). An even-numbered sheet is fixed at a position shown in FIG. 5B without rotating the size-switching flapper 568*a*, and is guided into the sheet accommodating path 569 directly from the punching path 558. It is thereby possible to shorten a time of superposition of sheets, and provide a time for processing to be performed in a state in which the sheets are free (for example, aligning processing).

Upon completion of sheet aligning processing in the above-described manner, the one roller 562*a* of the pair of pressing rollers 562 again returns to a position indicated by solid lines in FIG. 5A to grasp the sheet, and conveys the sheet at a conveying speed larger than the speed before the aligning processing. At that time, since the stopper 563 protrudes in the conveying path, the leading edge of the sheet can be aligned by assuredly contacting the stopper unit in the aligning processing even if the leading edge of the sheet separates from the stopper 563.

The punching unit (punching means) 560 is, for example, a punching device described in Japanese Patent Application Laid-Open No. 2001-129792, that sequentially performs a punching operation for each of sheets individually conveyed to a predetermined punching position within a conveying path. The stopper 563 is disposed at a portion downstream from the punching unit 560 in the conveying path.

Figure 8:
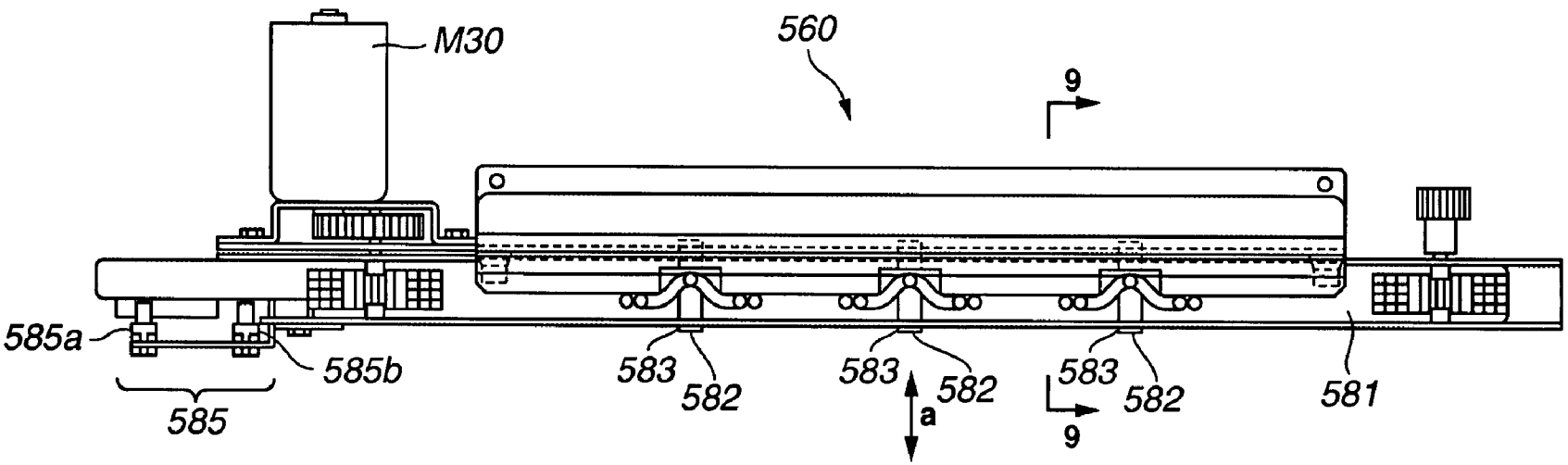
FIG. 8 is a cross-sectional view illustrating a punching unit.
Figure 9:
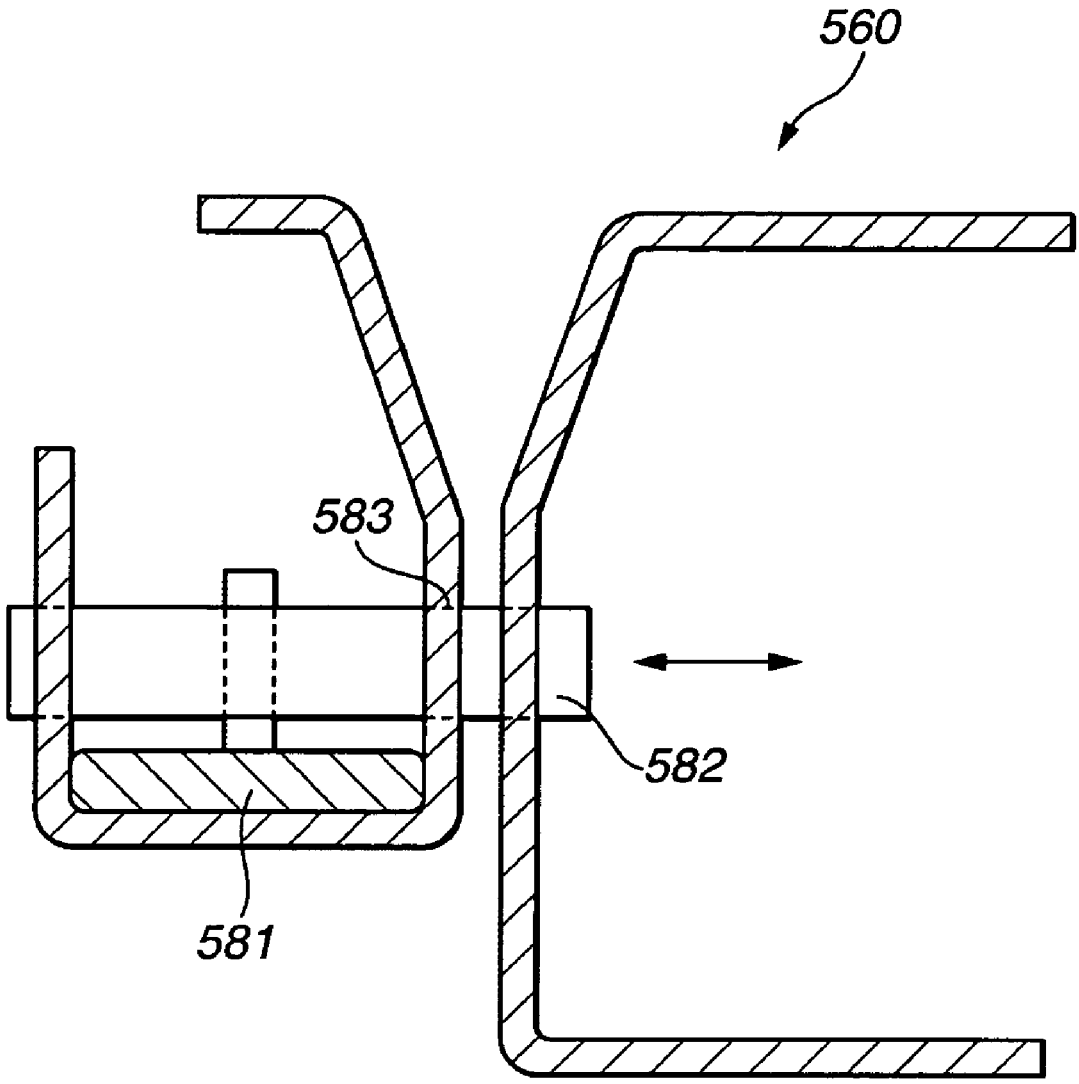
FIG. 9 is a cross-sectional view taken along line 9—9 shown in FIG. 8.
Figure 10:
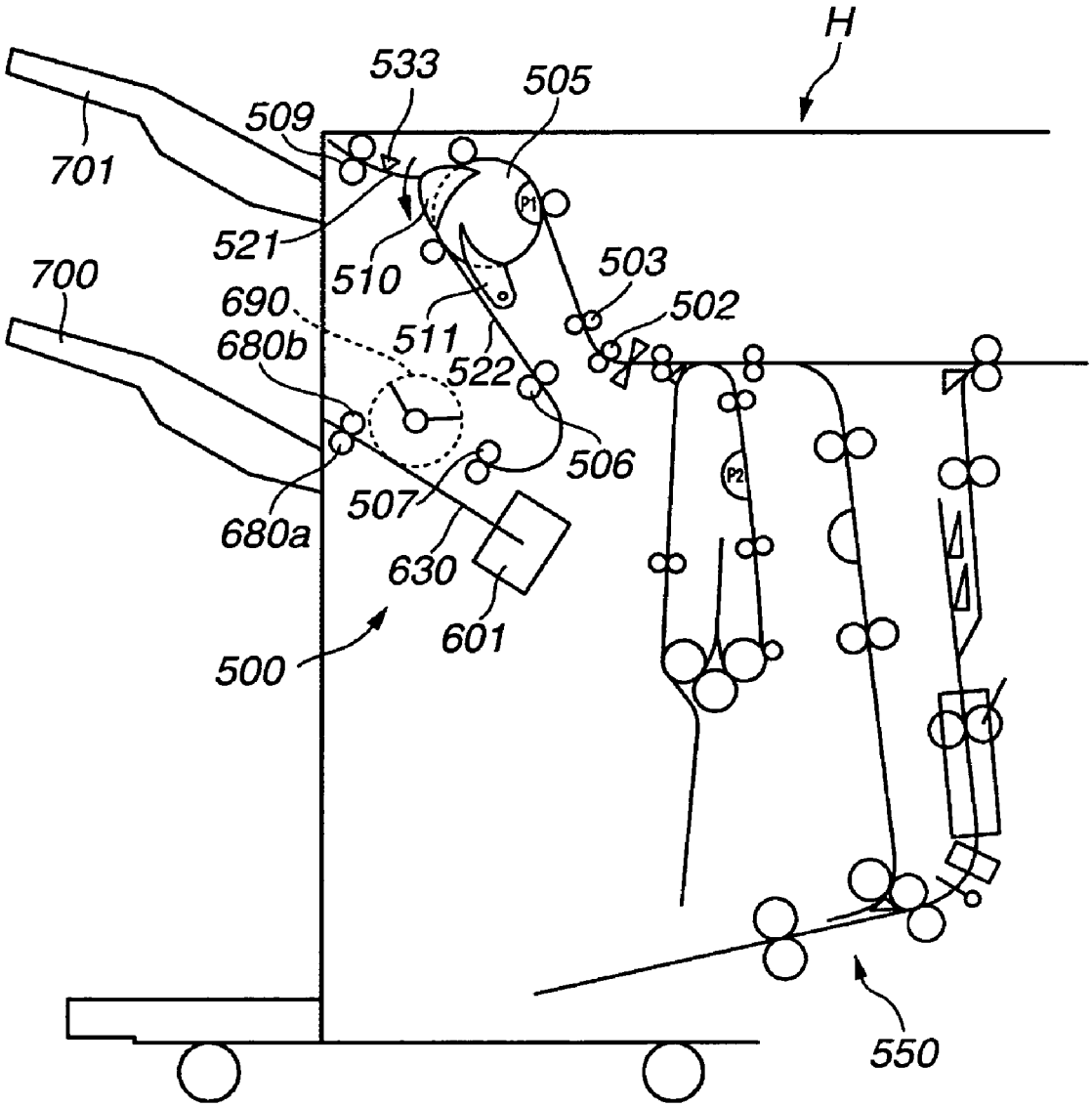
FIGS. 10, 11, and 12A and 12B are diagrams illustrating the flow of a sheet when a sheet from a printer unit is discharged and mounted onto a processing tray.

As shown in FIGS. 8 and 9, the punching unit 560 includes a reciprocatable cam member 581 where a cam is formed, a punch 582 engaging with the cam of the cam member 581 and capable of performing reciprocating movement in a direction "a" orthogonal to the moving direction of the cam member 581 in accordance with reciprocating movement of the cam member 581, a die 583 having a die hole where the punch 581 is to enter formed therein, a cam-member driving motor M30 (hereinafter termed a "punching motor") for reciprocating the cam member 581, and a cam-member-position detection sensor 585 for stopping the punching motor M30 by detecting the moved position of the cam member 581, and can perform high-speed punching processing for the sheet in a state in which the leading edge of the sheet assuredly contacts the punching stopper 563.

When the sheet is not separated from the punching stopper 563 after aligning processing in a configuration in which the sheet accommodating path 569 is substantially vertical as shown in this embodiment, punching processing may be performed by the punching unit 560 immediately after alignment, and thereafter sheet conveyance may be started by the pair of pressing rollers 562.

By adopting a configuration in which a mounting stopper operating in the same manner as the above-described punching stopper 563 is provided near the punching unit 560 at the upstream side in the sheet conveying path, and a mechanism for individually separating sheets mounted on the mounting stopper is provided, it is possible to accommodate at least three sheets in the sheet accommodating path 569, and perform stable punching processing for sheets conveyed at a higher speed and with a smaller interval between the sheets.

When punching processing has been performed for a sheet, the punching stopper 563 retracts from the conveying path, and the sheet is fed to a reversal unit 561 by the pair of pressing rollers 562. When the rear edge of the sheet passes through the punching stopper 563, the punching stopper 563 again protrudes into the conveying path, to contact the leading edge of the subsequently fed sheet. The conveying speed of the subsequent sheet is larger that the speed before aligning processing (for example, about twice the speed before alignment), so that the leading edge of the subsequent sheet does not reach the punching stopper 563 before the rear edge of the sheet passes through the punching stopper 563.

In the reversal unit 561, the sheet is drawn into a reversal path 566 by a pair of reversal rollers 565, and the pair of reversal rollers 565 perform reverse rotation when the rear edge of the sheet passes through a reversal flapper 567. At that time, the direction of the reversal flapper 567 is switched, and the sheet is guided to a conveying path 578. The sheet guided to the conveying path 578 is fed to a conveying path 402 by respective pairs of conveying rollers 571 and 572.

A description of the folding unit 400 and the finisher unit 500 will be omitted.

Figure 6:
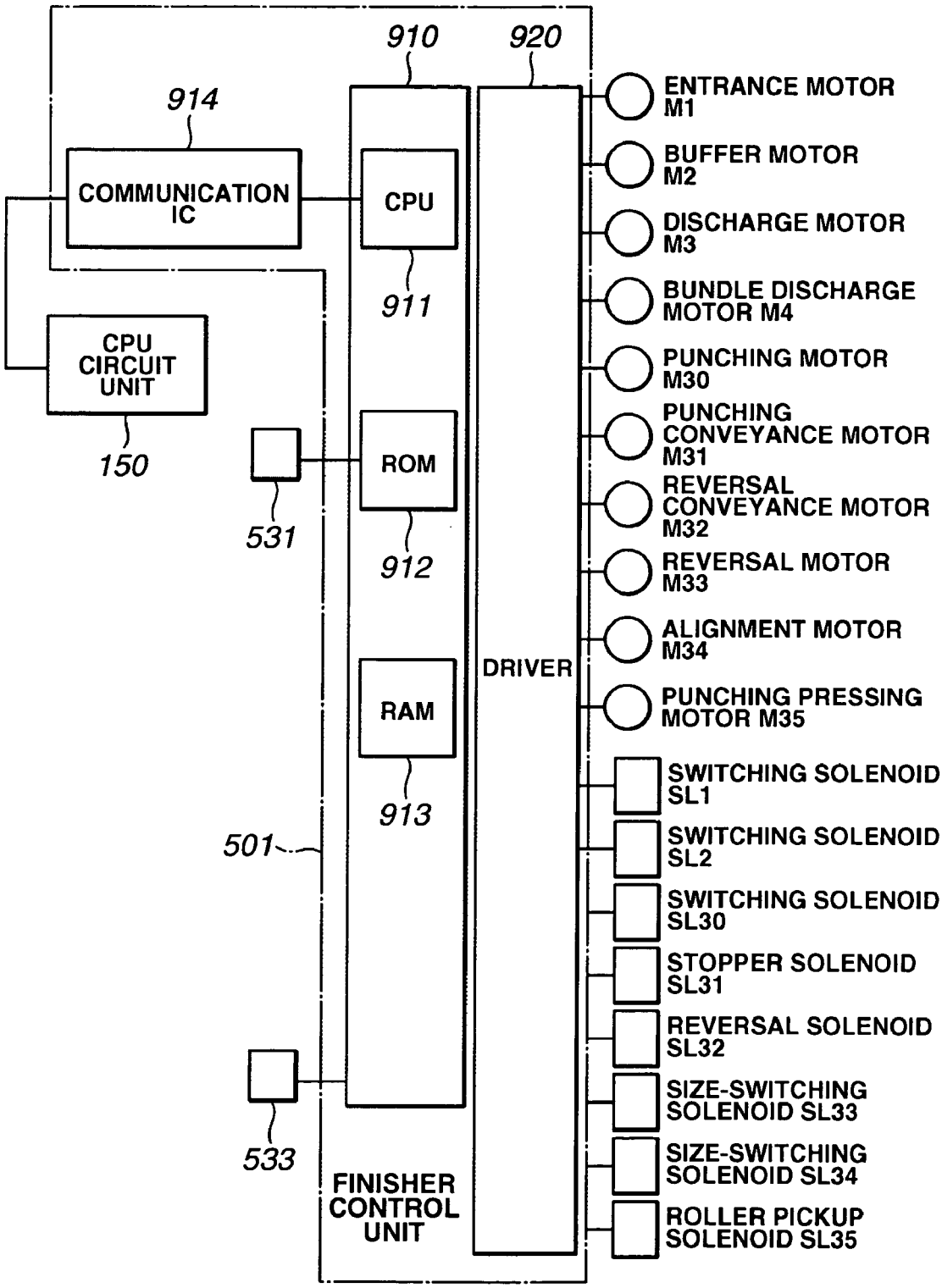
FIG. 6 is a functional block diagram illustrating a finisher control unit for controlling driving of the finisher unit shown in FIG. 5A.

Next, a description will be provided of the configuration of the finisher control unit 501 for controlling driving of the finisher unit 500, with reference to FIG. 6. FIG. 6 is a functional block diagram illustrating the configuration of the finisher control unit 501 shown in FIG. 3.

As shown in FIG. 6, the finisher control unit 501 includes a CPU circuit unit 910 including a CPU 911, a ROM 912, a RAM 913 and the like. The CPU circuit unit 910 performs data exchange by communicating with the CPU circuit unit 150 provided at the main body of the copier via a communication IC (integrated circuit) 914, and controls driving of the finisher unit 500 by executing various programs stored in the ROM 912 based on instructions from the CPU circuit unit 150. The CPU circuit unit 910 also includes a jam timer (not shown) for detecting a jam.

When controlling driving of the finisher unit 500, detection signals from various sensors are input to the CPU circuit unit 150. The various sensors include an entrance sensor 521 and a discharge sensor 533 (see FIG. 5A).

A driver 920 is connected to the CPU circuit unit 910. The driver 920 drives various motors and solenoids, and the like, based on signals from the CPU circuit unit 910.

The various motors include an entrance motor M1, serving as a driving source for a pair of conveying rollers 503, a buffer motor M2, serving as a driving source for a buffer roller 505, a discharge motor M3, serving as a driving source for a pair of conveying rollers 506, a pair of discharge rollers 507, and a pair of discharge rollers 509, a bundle discharge motor M4, serving as a driving source for discharge rollers 680*a* and 680*b*, and a punching conveyance motor M31 for driving respective pairs of conveying rollers 556 and 559 for conveying a sheet to the punching unit 560, an alignment motor M34 for aligning a sheet whose leading edge has reached the punching stopper 563 at a position adjusted to the punching unit 560 in a direction substantially orthogonal to the sheet conveying direction, a punching pressing motor M35 for driving the pressing rollers 562 for pressing the sheet against the punching stopper 563, a punching motor M30 for reciprocating the cam member 581 for reciprocating the punch 582 within the punching unit 560, a reversal motor M33 for driving the pair of reversal rollers 565 for drawing the sheet into the reversal path 566 and feed the sheet in a switchback state, and a reversal conveyance motor M32 for driving conveying rollers 573 for conveying the sheet into the reversal path 566 and further feed the reversed sheet to the conveying path 578.

Each of the above-described motors can rotate a roller driven by the motor at a constant speed, or rotate the corresponding roller at a particular speed. Each of the motors can be driven in any one of normal and reverse directions of revolution by the driver 920.

The solenoids include a switching solenoid SL1 for switching a switching flapper 510, a switching solenoid SL2 for switching a switching flapper 511, a switching solenoid SL30 for switching a switching flapper 557, size-switching solenoids SL 33 and SL34 for switching a path in accordance with the length of the sheet entering the sheet accommodating path 569, a stopper solenoid SL31 for protruding the punching stopper 563 into the conveying path or retracting the punching stopper 563 from the inside of the conveying path, a reversal solenoid SL32 for driving the reversal flapper 567 for switching the conveying path, and a roller pickup solenoid SL35 for causing the one roller 562*a* of the pair of pressing rollers 562 to pick up the sheet.

Figure 7:
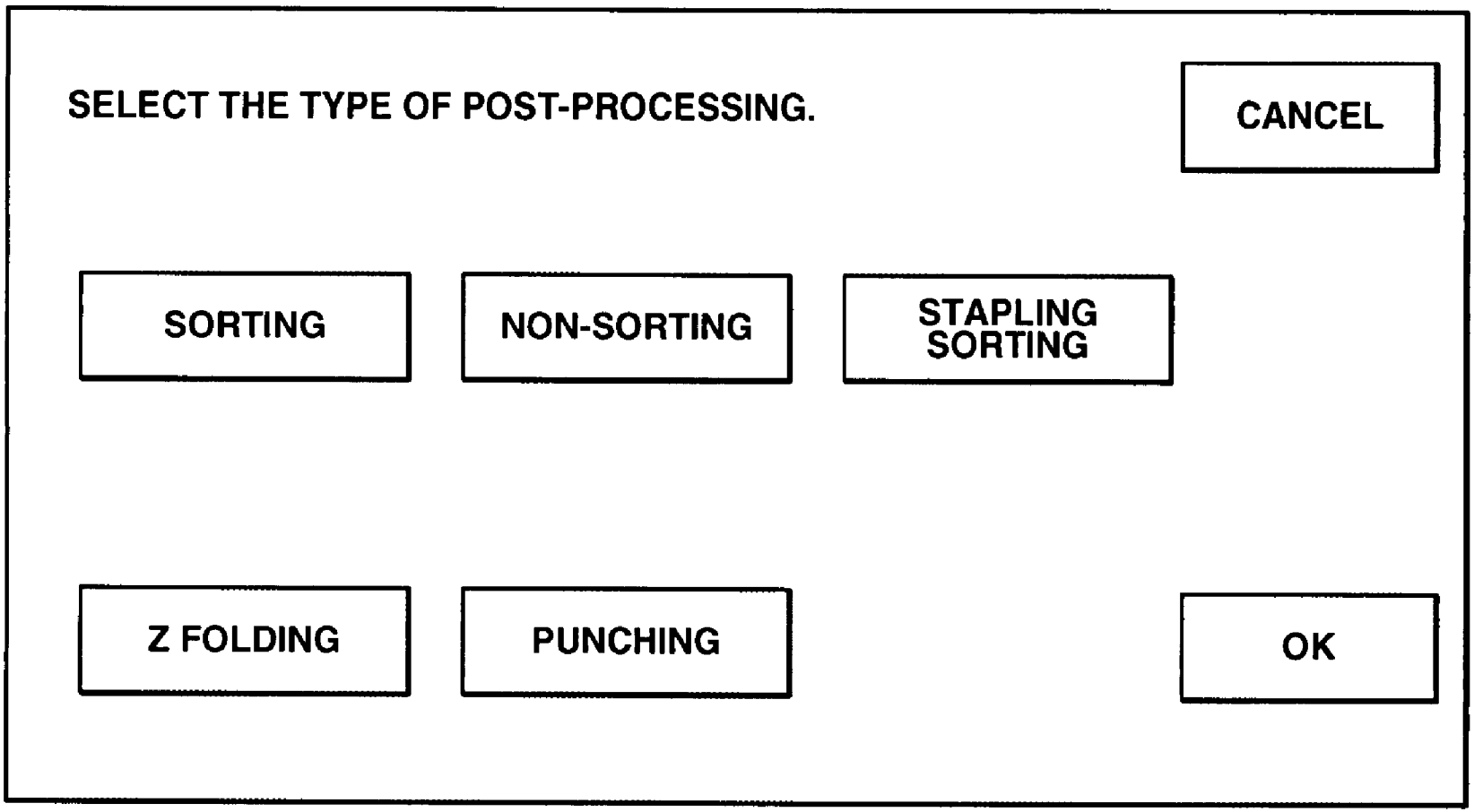
FIG. 7 is a diagram illustrating a display panel of an operation unit.

Next, a method for setting an operation mode will be described with reference to FIG. 7. FIG. 7 illustrates a picture frame displayed on the display panel of the operation unit 1 of the copier 1000. This picture frame operates as a touch-panel. By touching the inside of a frame surrounding a displayed function, the function is executed.

In the picture frame shown in FIG. 7, the user can select one of operation modes, such as a non-sorting mode, a sorting mode, a stapling sorting mode (binding mode), a punching mode, a Z folding mode and the like.

As described above, in the original-flowing reading, mirror-image processing (i.e., processing of rotating an input image by 180 degrees) is performed for read image information so that an erect image is formed on a sheet. An image is formed on the sheet based on the image information subjected to mirror-image processing. The surface of the sheet is reversed within the printer unit 300 or the punching processing unit 550 and is subjected to reversal discharge. Hence, when the sheet P having the formed image is received into the finisher unit 500, the surface having the formed image is placed downward (the face-down state). Accordingly, as shown in FIGS. 10–12B, a sheet P1 and a sheet P2 conveyed from the printer unit 300 are conveyed to the finisher unit 500 in a state in which the surface of the sheet having the formed image is placed downward.

The sheet P1 fed to the finisher unit 500 is conveyed to the buffer roller 505 via a finisher path 552, and is guided to a sorting path 522. At that time, following the sheet P1, conveyance of the sheet P2 from the printer unit 300 into the finisher unit 500 is started.

Figure 11:
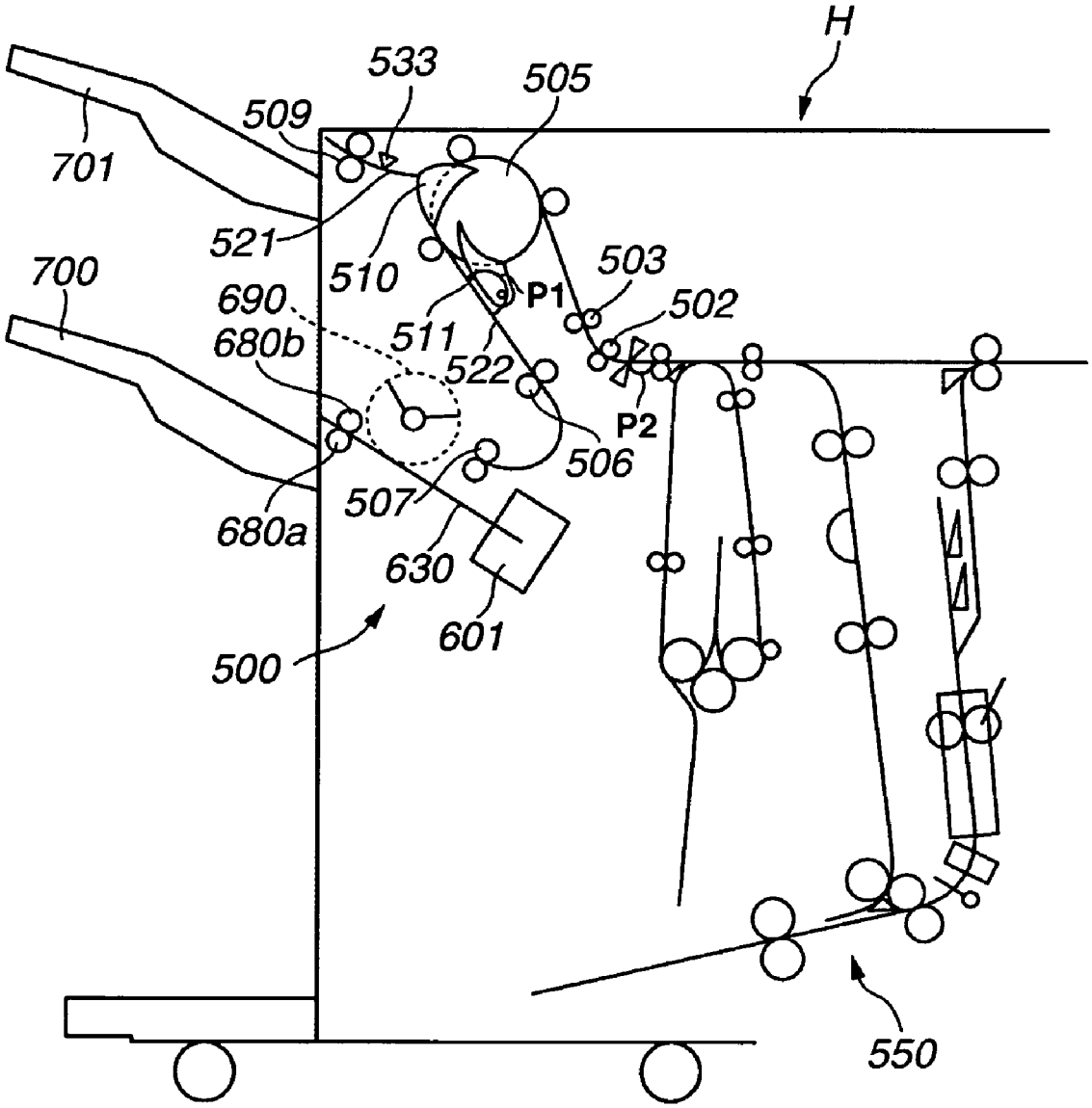

Then, as shown in FIG. 11, the sheet P1 is discharged and mounted onto a processing tray 630 in a state in which the surface of the sheet having the formed image is placed downward, and in a state in which the binding position faces a stapler 601. The sheet P2 succeeding the sheet P1 is guided to the main body of the finisher unit 500 and is conveyed to the buffer roller 505. Thus, the sheet P1 and the sheet P2 are sequentially discharged and mounted onto the processing tray 630.

Figure 12A:
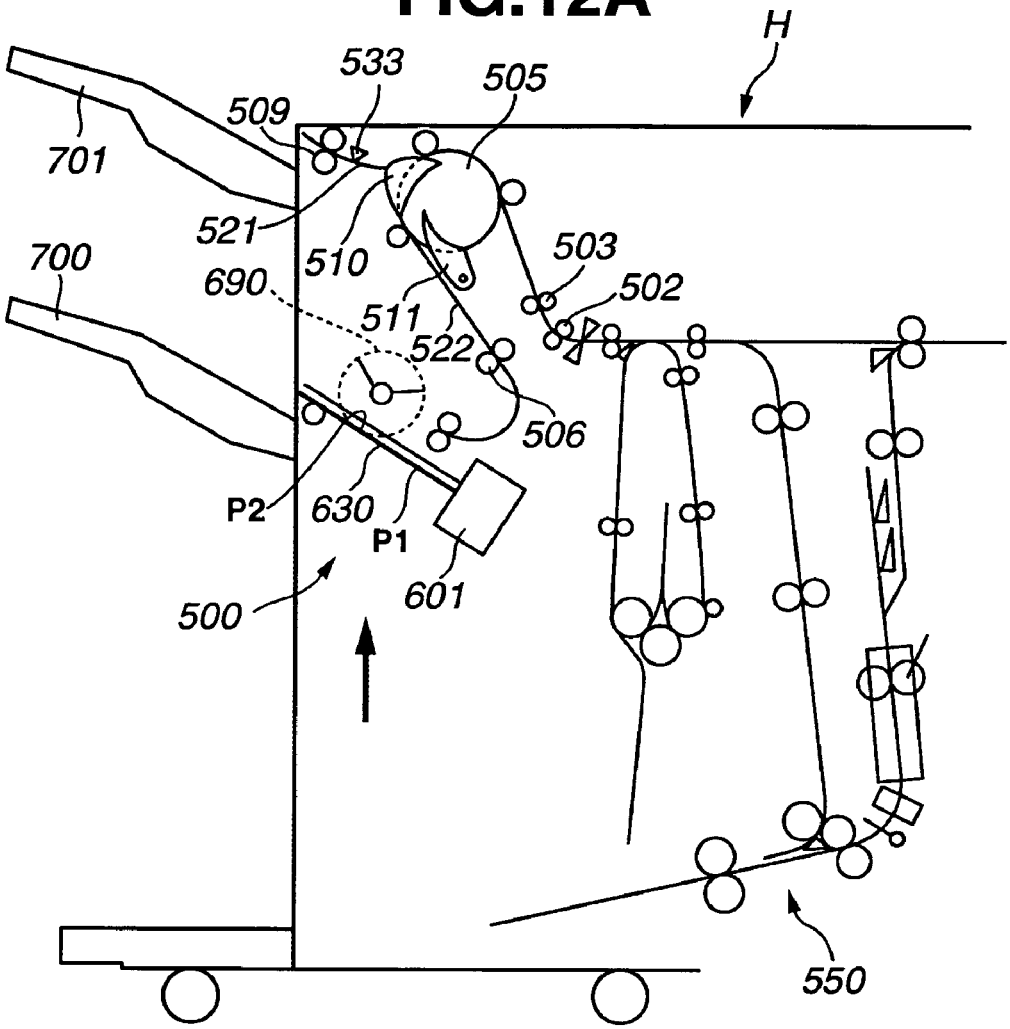

As shown in FIG. 12A, the sheet P2 succeeding the sheet P1 is accommodated in a state of being superposed on the sheet P1. The images formed on the sheet P1 and the sheet P2 have been subjected to mirror-image processing so as to provide erect images. When a sheet is conveyed from the printer unit 300 to the finisher unit 500, the surface of the sheet can be reversed at the printer unit 300 or within the punching processing unit 550. Accordingly, the sheet P1 and the sheet P2 are mounted onto the processing tray 630 in a state in which the surface having the formed image is placed downward (the face-down state), and in a state in which the punched positions and the binding positions face the stapler 601.

Figure 12B:
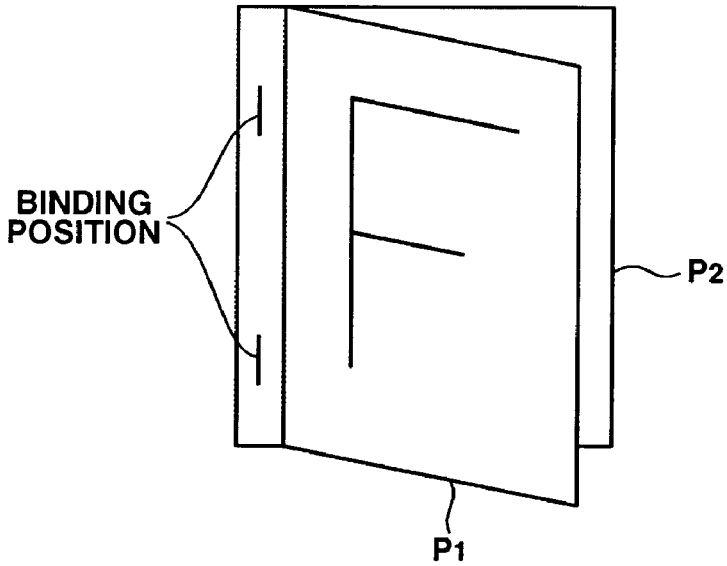

When performing binding processing for a sheet bundle including such a plurality of sheets, binding processing is performed by the stapler 601 when the sheet P2 has been discharged and mounted onto the processing tray 630. FIG. 12B illustrates a sheet bundle including the sheet P1 and the sheet P2 subjected to binding processing by the stapler 601.

As described above, in this embodiment, processing of rotating an input image by 180 degrees (termed "mirror-image processing" in this embodiment), the image subjected to mirror-image processing is formed on a sheet, and the sheet having the formed image is mounted onto the processing tray 630.

Although in this embodiment, the case in which the image of the original D is input from the image-reader unit 200 has been described, it is also possible to apply the present invention to a case in which image information is input from the external computer 210, and to form an image on the sheet P by performing the same processing (see FIG. 3). Rotation processing (termed "mirror-image processing" in this embodiment) is performed for the input image whenever necessary, an image is formed on the sheet P based on image information subjected to mirror-image processing, and the sheet P having the formed image is discharged to the finisher unit 500 by reversing the surface of the sheet P. As a result, leading-page processing and post-processing can be compatible. When performing post-processing, comprising stapling processing and the like, for a sheet bundle including a plurality of sheets discharged and mounted onto the processing tray 630, the direction and the binding position of the image on each of the sheets can coincide.

Next, processing relating to control of driving of the finisher unit 500 will be described.

Figure 13:
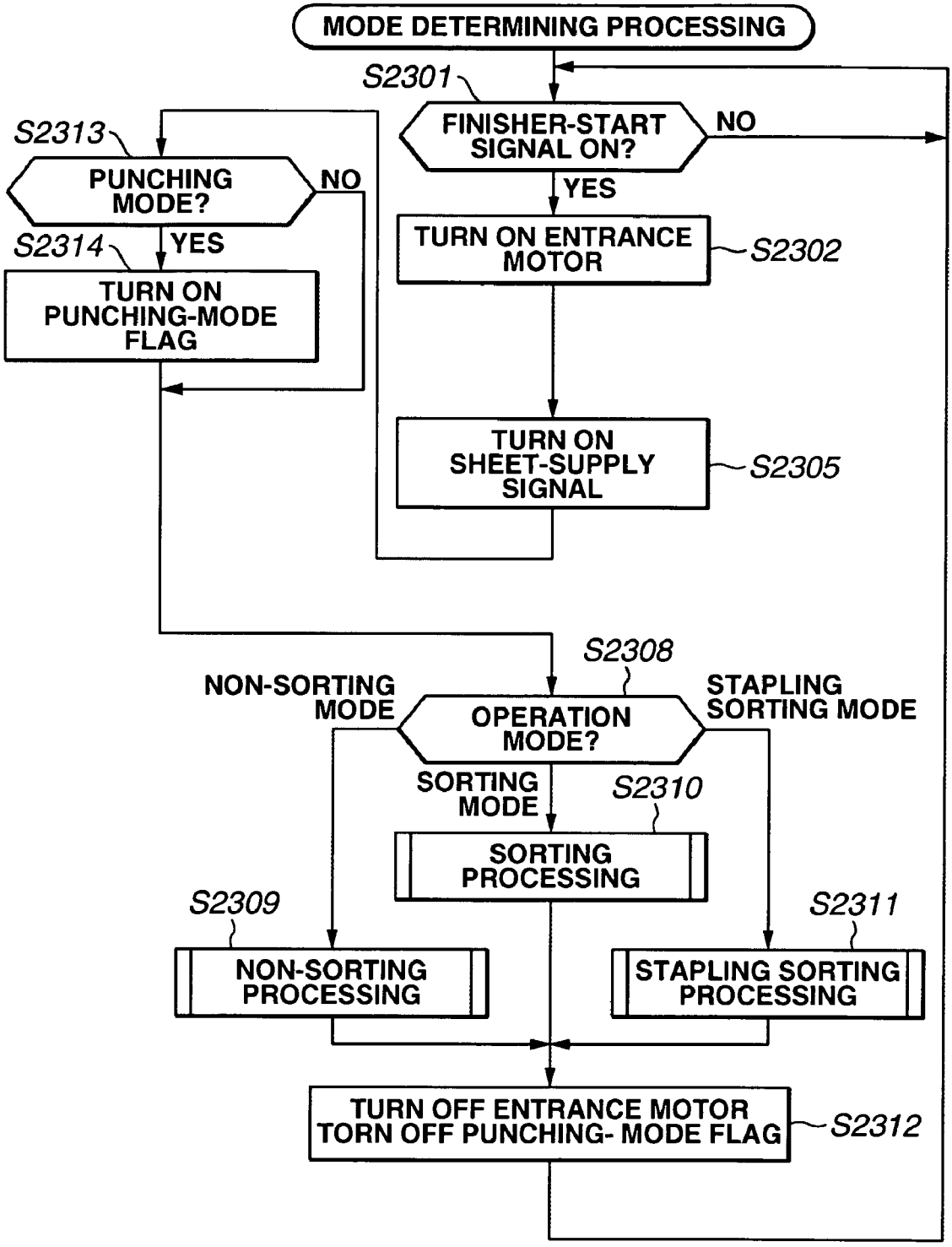
FIG. 13 is a flowchart illustrating operation-mode determining processing.

FIG. 13 is a flowchart illustrating processing for determining an operation mode for the finisher unit 500. This processing is executed by the CPU circuit unit 910 within the finisher control unit 501 based on instructions from the CPU circuit unit 150.

First, it is determined whether or not a finisher-start signal for instructing start of an operation for the finisher unit 500 has been input to the finisher control unit 501 (step S2301). The processing of step S2301 is repeated until a start key for instructing start of a copying operation is depressed on the operation unit 1 by the user, and a finisher-start signal is input from the CPU circuit unit 150 to the finisher control unit 501.

If the result of the determination in step S2301 is affirmative, driving of the entrance motor Ml is started (step S2302).

Then, a supply signal is output to the CPU circuit unit 150 of the copier 1000 via the communication IC 914 (step S2305). The CPU circuit unit 150 that has received this supply signal starts image forming processing.

Then, in a post-processing selection menu picture frame shown in FIG. 7, it is determined whether or not a punching mode has been set by the user (step S2313). If the result of the determination in step S2313 is affirmative, a punching-mode flag is turned on (step S2314), and the process proceeds to step S2308. If the result of the determination in step S2313 is negative, the process proceeds to step S2308.

In step S2308, it is determined which one of a non-sorting mode, a sorting mode and a stapling sorting mode corresponds to the set operation mode. If it is determined in step S2308 that the set operation mode is the non-sorting mode, non-sorting processing is performed (step S2309).

If it is determined in step S2308 that the set operation mode is the sorting mode, sorting processing is performed (step S2310).

If it is determined in step S2308 that the set operation mode is the stapling sorting mode, stapling sorting processing is performed (step S2311).

When the non-sorting processing has been completed in step S2309, when the sorting processing has been completed in step S2310, or when the stapling sorting processing has been completed in step S2311, driving of the entrance motor M1 is stopped. When the punching-mode flag has been turned on in step S2314, the punching-mode flag is turned off (step S2312). Then, the process returns to step S2301, and input of a finisher-start signal is awaited.

As described above, the sheet can be guided to the processing tray 630 by performing switching by rotating the switching flappers 510 and 511, and aligning processing for a bundle of sheets discharged and mounted on the processing tray 630 can be performed. It is also possible to perform binding processing in which a sheet bundle mounted on the processing tray 630 is bound, using the stapler 601.

Figure 14:
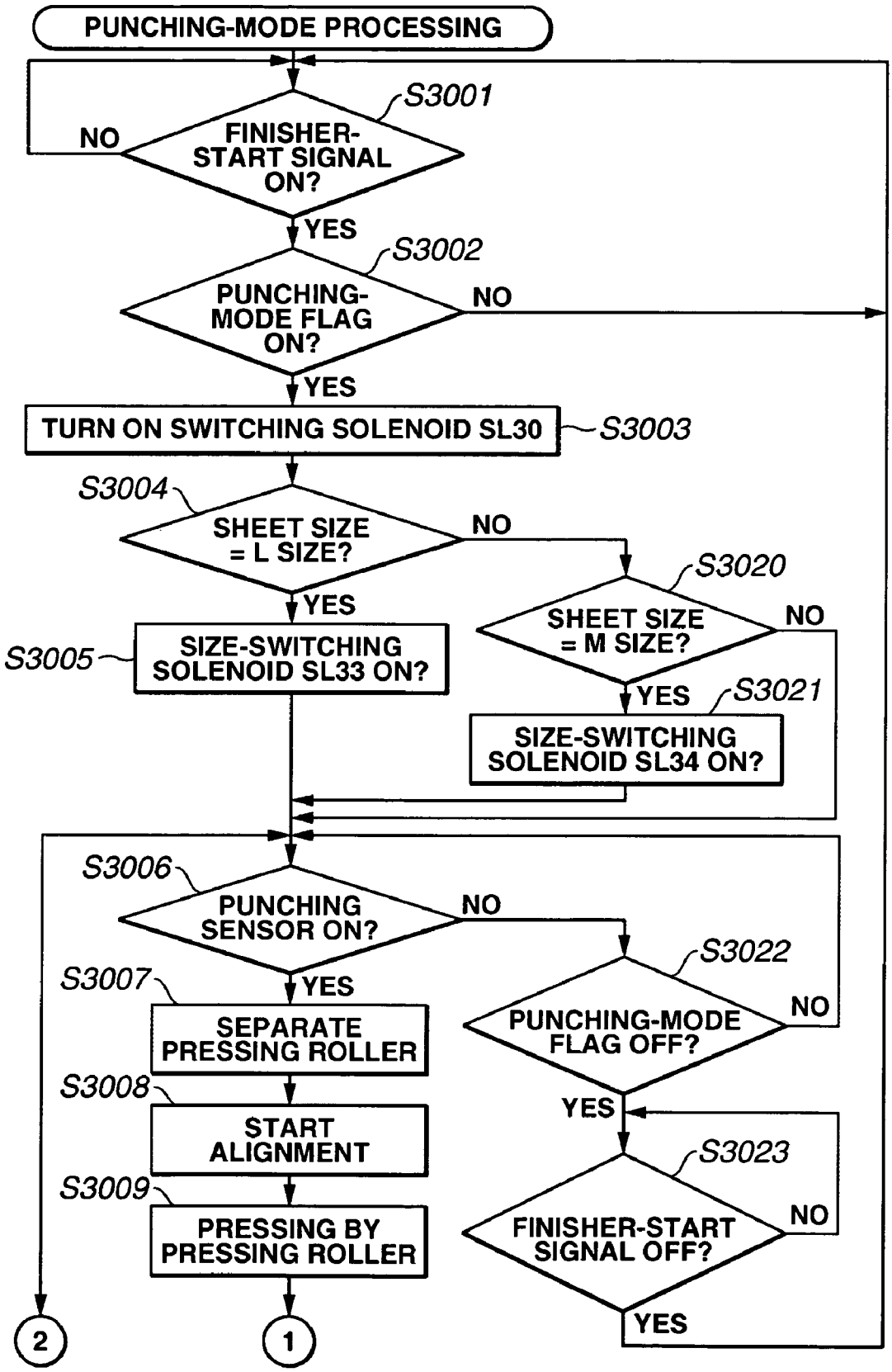
FIGS. 14 and 15 are flowcharts illustrating punching-mode processing.
Figure 15:
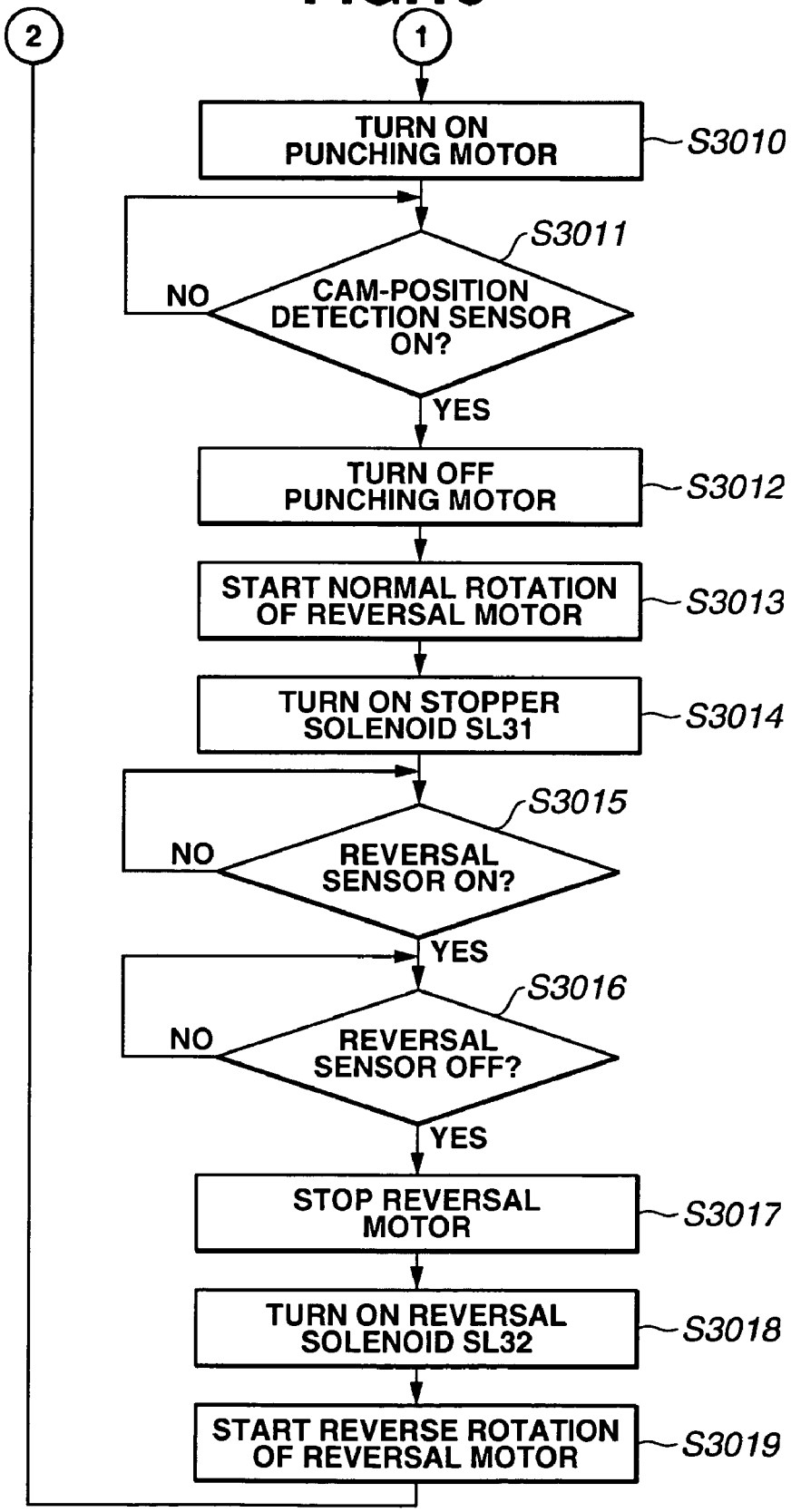

Next, punching-mode processing will be described with reference to the flowcharts shown in FIGS. 14 and 15. This processing is executed by the CPU circuit unit 910 within the finisher control unit 501 based on instructions from the CPU circuit unit 150 of the main body, while always performing monitoring.

First, an instruction to start an operation for the finisher unit 500 is input from the CPU circuit unit 150 to the CPU circuit unit 910 within the finisher control unit 501, and it is determined whether or not a finisher-start signal is in an on-state (step S3001). The processing of step S3001 is repeated until a finisher-start signal is turned on.

If the result of the determination in step S3001 is affirmative, then, it is determined whether or not a punching-mode flag has been turned on in the above-described processing of step S2314 shown in FIG. 13 (step S3002). If the result of the determination in step S3002 is negative, the process returns to step S3001. If the result of the determination in step S3002 is affirmative, the switching solenoid SL30 is turned on (step S3003), and the sheet is guided to the punching path 558 by the switching flapper 557. The sheet guided to the punching path 558 reaches the size-switching flapper 568 via the pair of conveying rollers 559. The sheet sizes are classified in advance in three types. These sizes are represented by an L (large) size, an M (medium) size and an S (small) size. When the sheet size is the L size, the size-switching solenoid SL33 is turned on (step S3005), and the size-switching flapper 568*b* rotates in the direction of the arrow A shown in FIG. 5A, to switch the path to an L path 574 (see FIG. 5C). When the sheet size is the M size, the size-switching solenoid SL34 is turned while the size-switching solenoid SL33 remains in an off-state, and the path is switched to an M path 575 by the size-switching flapper 568*b* (step S3021). When the sheet size is the S size, the size-switching solenoids SL33 and SL34 are not turned on. The sheet passes through an S path 576, is conveyed along the sheet accommodating path 569 by the pair of pressing rollers 562, and the leading edge of the sheet reaches the punching stopper 563.

The number of each of the size-switching flappers and the size-switching solenoids is not limited to two as in this embodiment. By further increasing the number of size-switching flappers, sheets of a larger number of sizes can be handled.

By adopting a configuration in which a punching stopper unit obtained by integrating the punching stopper 563, the punching unit 560 and a punching sensor 570 is movable in the sheet conveying direction, without using size-switching flappers and size-switching solenoids, and moving the punching stopper unit to a position corresponding to the size of sheets to be subjected to punching processing, the rear edge of a sheet already contacting the punching stopper 563 and the leading edge of the subsequently conveyed sheet may be superposed without contacting.

Then, it is determined whether or not the punching sensor 570 is in an on-state (step S3006). If the result of the determination in step S3006 is affirmative, it indicates that the sheet has reached the punching unit 560. Accordingly, the roller pickup solenoid SL35 is turned on, and the one roller 562*a* of the pair of pressing rollers 562 separates from the sheet (step S3007). An aligning operation by the aligning plate 564 driven by the aligning motor M34 is performed for the sheet in a state in which the sheet can freely move without being hindered by the pressing roller and the like as described above (step S3008). Upon completion of the sheet aligning operation, the roller-pickup solenoid SL35 is turned off, and the one roller 562*a* of the pair of pressing rollers 562 is again brought in pressure contact with the sheet (step S3009), to start sheet conveyance. When a loop starts to be formed after the lapse of a predetermined time after the sheet has been further strongly pressed against the punching stopper 563, the punching motor M30 is driven (step S3010 shown in FIG. 18), to move the cam member 581. After the cam member 581 has moved by a predetermined amount and the punch 582 has performed punching processing for the sheet, the cam member 581 is detected by a cam-member-position detection sensor 585 (step S3011), and driving of the punching motor M30 is stopped (step S3012). After the punching motor M30 has stopped, the reversal motor M33 starts normal rotation, to prepare to draw the sheet into the reversal path 566 (step S3013). Then, the stopper solenoid SL31 is turned on (step S3014), the punching stopper 563 retracts from the conveying path, and the sheet is conveyed to the conveying rollers 573 by the pair of pressing rollers 562. Then, the sheet is conveyed into the reversal path 566 by the conveying rollers 573 and the pair of reversal rollers 565. At that time, the conveying speed by the conveying rollers 573 and the pair of reversal rollers 565 is larger than the conveying speed of the pair of conveying rollers 559, so that the sheet can be drawn from the sheet accommodating path 569 at a high speed.

The amount of sheet conveyance by the pair of pressing rollers 562 can be measured by an encoder (not shown). By measuring the amount of sheet conveyance by the encoder, the stopper solenoid SL31 is turned off when the rear edge of the sheet passes through the punching stopper 563, to again protrude the punching stopper 563 into the conveying path.

When the reversal sensor 577 has detected the sheet (step S3015), and the rear edge of the sheet has been detected by passage of the sheet through the reversal sensor 577 (step S3016), the pair of reversal rollers 565 temporarily stops by stopping the reversal motor M33 (step S3017). Then, the reversal solenoid SL32 is turned on (step S3018), and the path is switched by the reversal flapper 567. Thereafter, by reverse revolution of the reversal motor M33, the pair of reversal rollers 565 starts reverse rotation (step S3019), and the sheet is conveyed from the conveying path 578 to the conveying path 402 via the respective pairs of conveying rollers 571 and 572. Then, the process returns to step S3006 shown in FIG. 17.

If the result of the determination in step S3006 is negative, it is determined whether or not a punching-mode flag is in an off-state (step S3022). If the result of the determination in step S3022 is negative, the process returns to step S3006. If the result of the determination in step S3022 is affirmative, it is awaited that the finisher-start signal is turned off (step S3023). When the finisher-start signal has been turned off, the process returns to step S3001.

As described above, it is possible to realize an image forming apparatus, including a sheet processing apparatus and a printer unit (image forming unit) for forming an image on a sheet, that performs punching processing for the sheet on which the image has been formed by the image forming unit, by the sheet processing unit.

The CPU circuit unit can cause one of the aligning plate and the stopper to perform a positioning operation before a punching operation by the punching unit. A positioning operation by the aligning plate and a positioning operation by the stopper can, of course, also be simultaneously performed. In another approach, it is also possible to cause one of the aligning plate and the stopper to perform a positioning operation after causing the other one to perform a positioning operation.

The punching unit punches at least two arranged holes in a sheet. The CPU circuit unit can cause one of the aligning plate and the stopper to perform a positioning operation after causing the other one to perform a positioning operation, based on the relationship between the sheet conveying direction and the direction of arrangement of the at least two holes in the sheet. More specifically, it is possible to provide a configuration in which, when the sheet conveying direction is substantially orthogonal to the direction of arrangement of the holes, a positioning operation by the aligning plate is performed before a positioning operation by the stopper, and when the sheet conveying direction is substantially parallel with the direction of arrangement of the holes, a positioning operation by the stopper is performed before a positioning operation by the aligning plate.

Although the CPU circuit unit can cause the aligning plate and the stopper to perform respective positioning operations simultaneously, the CPU circuit unit may cause one of the aligning plate and the stopper to perform a positioning operation after causing the other one to perform a positioning operation.

More specifically, a configuration may be adopted in which the punching unit punches at least two arranged holes in a sheet, and the CPU circuit unit causes one of the aligning plate and the stopper to perform a positioning operation after causing the other one to perform a positioning operation, based on the relationship between the sheet conveying direction and the direction of arrangement of the holes.

That is, it is desirable to adopt a configuration in which, when the sheet conveying direction is substantially orthogonal to the direction of arrangement of the holes, the CPU circuit unit causes the aligning plate to perform a positioning operation before a positioning operation by the stopper. According to this configuration, since positioning of a sheet with respect to predetermined punching positions in the conveying direction that tends to influence the punching positions is performed later, punching processing having high position accuracy can be performed for the sheet.

On the other hand, it is desirable to adopt a configuration in which, when the sheet conveying direction is substantially parallel to the direction of arrangement of the holes, the CPU circuit unit causes the stopper to perform a positioning operation before a positioning operation by the aligning plate. According to this configuration, since positioning of a sheet with respect to predetermined punching positions in a direction substantially orthogonal to the conveying direction that tends to influence the punching positions is performed later, punching processing having high position accuracy can be performed for the sheet.

The individual components shown in outline or designated by blocks in the drawings are all well known in the sheet processing apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for controlling a sheet processing apparatus said sheet processing apparatus including:

a positioning unit arranged to position each of sequentially conveyed sheets at a predetermined position, wherein said positioning unit positions a sheet at a predetermined punching position in a direction substantially orthogonal to a conveying direction of the sheet, by grasping both end portions of the sheet in a lateral direction;

an accommodating unit disposed at a portion upstream of said positioning unit and arranged to accommodate the sheet to be conveyed to said positioning unit;

a punching unit arranged to perform punching one-by-one for a sheet positioned by said positioning unit; and a discharge unit arranged to discharge a sheet punched by said punching unit, said method for controlling the sheet processing apparatus comprising:

a first controlling step of making said positioning unit operate to position one-by-one the sheet prior to a punching operation by said punching unit; and a second controlling step of making said accommodating unit accommodate subsequently conveyed sheets during the positioning operation or the punching operation.

2. An apparatus according to claim 1, wherein said accommodating unit is able to accommodate a plurality of sheets.

3. An apparatus according to claim 1, wherein said accommodating unit shifts the position to accommodate the sheets depending on the size of conveyed sheets.

4. A sheet processing apparatus comprising:

a positioning unit arranged to position each of sequentially conveyed sheets at a predetermined position, wherein said positioning unit positions a sheet at a predetermined punching position in a direction substantially orthogonal to a conveying direction of the sheet, by grasping both end portions of the sheet in a lateral direction;

an accommodating unit disposed at a portion upstream of said positioning unit and arranged to accommodate a sheet to be conveyed to said positioning unit;

a punching unit arranged to perform punching one-by-one for a sheet positioned by said positioning unit;

a discharge unit arranged to discharge a sheet punched by said punching unit; and a controlling unit arranged to make said positioning unit operate to position one-by-one the sheet prior to a punching operation by said punching unit and to make said accommodating unit accommodate subsequently conveyed sheets during the positioning operation or the punching operation.

5. An apparatus according to claim 1, wherein said positioning unit comprises a pair of grasping planes disposed substantially parallel to the conveying direction of the sheet, and wherein at least one of said grasping planes is movable in a direction substantially orthogonal to the conveying direction.

6. An apparatus according to claim 1, further comprises a stopper arranged to position the sheet at a predetermined punching position in the conveying direction of the sheet by contacting a leading edge of the conveyed sheet.

7. An apparatus according to claim 6, wherein said stopper is disposed at a portion downstream from said punching unit in a conveying path.

8. An apparatus according to claim 6, wherein said stopper comprises a contact member disposed so as to be movable between a contact position for performing the contact operation by contacting the leading edge of the conveyed sheet and a retracting position where conveyance of the sheet is not hindered.

9. An apparatus according to claim 6, wherein said punching unit punches at least two arranged holes in the sheet, and wherein, after performing a positioning operation according to one of positioning by grasping the sheet in the lateral direction and positioning by said stopper, said positioning unit performs a positioning operation according to the other positioning, based on a relationship between the conveying direction of the sheet and a direction of arrangement of the holes.

10. An apparatus according to 9, wherein said positioning unit performs the positioning operation by grasping the sheet in the lateral direction before the positioning operation by the stopper, when the conveying direction of the sheet is substantially orthogonal to the direction of arrangement of the holes.

11. An apparatus according to claim 9, wherein said positioning unit performs the positioning operation by the stopper before the positioning operation by grasping the sheet in the lateral direction, when the conveying direction of the sheet is substantially parallel to the direction of arrangement of the holes.

12. An image forming apparatus comprising:

an image forming unit arranged to form an image on a sheet;

a positioning unit arranged to position each of sequentially conveyed sheets on which images have been formed by said image forming unit, at a predetermined position, wherein said positioning unit positions a sheet at a predetermined punching position in a direction substantially orthogonal to a conveying direction of the sheet, by grasping both end portions of the sheet in a lateral direction;

an accommodating unit disposed at a portion upstream of said positioning unit and arranged to accommodate a sheet conveyed from said image forming unit and to be conveyed to said positioning unit;

a punching unit arranged to perform punching one-by-one for a sheet positioned by said positioning unit;

a discharge unit arranged to discharge a sheet punched by said punching unit; and a controlling unit arranged to make said positioning unit operate to position one-by-one the sheet prior to a punching operation by said punching unit and to make said accommodating unit accommodate subsequently conveyed sheets during the positioning operation and/or the punching operation.

* * * * *

UNITED STATES PATENT AND TRADEMARK OFFICE

CERTIFICATE OF CORRECTION

PATENT NO. : 7,134,370 B2
APPLICATION NO. : 10/691541
DATED : November 14, 2006
INVENTOR(S) : Mitsushige Murata et al.

It is certified that error appears in the above-identified patent and that said Letters Patent is hereby corrected as shown below:

ON THE TITLE PAGE:
At Item (74), Attorney, "Fitapatrick," should read --Fitzpatrick,--

COLUMN 9:
Line 21, "larger that" should read --larger than--.

COLUMN 10:
Line 26, "SL 33" should read --SL33--.

COLUMN 15:
Line 41, "apparatus" should read --apparatus,--.

COLUMN 16:
Line 26, "claim 1," should read --claim 4,--.

Signed and Sealed this

Twenty-fifth Day of December, 2007

JON W. DUDAS
*Director of the United States Patent and Trademark Office*